US006246858B1

(12) United States Patent
Condello et al.

(10) Patent No.: US 6,246,858 B1
(45) Date of Patent: Jun. 12, 2001

(54) ELECTROSTATOGRAPHIC REPRODUCTION MACHINE HAVING A FUSING BELT POSITION CHANGING MECHANISM

(75) Inventors: Anthony S. Condello, Webster; Mark S. Amico; Donald M. Bott, both of Rochester; Rabin Moser, Victor, all of NY (US); Derek E. Vaughan, Hertfordshire (GB)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/565,402

(22) Filed: May 5, 2000

Related U.S. Application Data

(60) Provisional application No. 60/146,387, filed on Aug. 2, 1999.

(51) Int. Cl.[7] ..... G03G 15/00

(52) U.S. Cl. ..... 399/329; 198/806

(58) Field of Search ..... 399/329, 328, 399/325, 327, 165; 219/216; 198/806

(56) References Cited

U.S. PATENT DOCUMENTS

| | | | | |
|---|---|---|---|---|
| 5,027,160 | * | 6/1991 | Okada et al. | 399/329 |
| 5,250,998 | | 10/1993 | Ueda et al. | 399/329 |
| 5,465,146 | | 11/1995 | Higashi et al. | 399/328 |
| 5,842,079 | * | 11/1998 | Miyamoto et al. | 399/329 X |
| 5,890,047 | * | 3/1999 | Moser | 399/329 |
| 6,088,558 | * | 7/2000 | Yamada et al. | 399/165 |

FOREIGN PATENT DOCUMENTS 11-116089 * 4/1999 (JP) .

* cited by examiner

*Primary Examiner*—Sophia S. Chen
(74) *Attorney, Agent, or Firm*—Tallam I. Nguti

(57) ABSTRACT

A contact belt fusing apparatus is provided for reducing sheet edge wear defects in fused copies. The fusing apparatus includes an endless fusing belt having an external fusing surface defining a path of movement and a plurality of support rollers for supporting and moving the endless fusing belt along the path of movement. The endless fusing belt as supported has a first fusing position aligned on the plurality of support rollers at a first location, and at least a second fusing position aligned on the plurality of support rollers at a second location that is spaced axially from the first location thereon. The fusing apparatus also includes heating member for heating the external fusing surface of the endless fusing belt, and a pressure roller forming a fusing nip with the external fusing surface of the endless fusing belt for contacting and moving toner image carrying sheets therethrough, the toner image carrying sheets having edges that induce wear on the external fusing surface of the endless fusing belt. Importantly, the fusing apparatus includes a belt moving mechanism for controllably moving the endless fusing belt axially, relative to the plurality of rollers, from the first fusing position to the at least second fusing position, so as to reduce sheet edge wear on the external fusing surface of the endless fusing belt.

8 Claims, 3 Drawing Sheets

ELECTROSTATOGRAPHIC REPRODUCTION MACHINE HAVING A FUSING BELT POSITION CHANGING MECHANISM

This Application is based on a Provisional Application No. 60/146,387 filed Aug. 2, 1999.

RELATED APPLICATIONS

This Application is related to U.S. application Ser. No. 60/146,362 entitled "ELECTROSTATOGRAPHIC REPRODUCTION MACHINE INCLUDING A DUAL FUNCTION FUSING BELT DESKEWING AND OILING ASSEMBLY" and to U.S. application Ser. No. 60/146,372 entitled "ELECTROSTATOGRAPHIC REPRODUCTION MACHINE INCLUDING A DUAL FUNCTION FUSING BELT DESKEWING AND HEATING ASSEMBLY" both filed on the same date herewith; and each having at least one common inventor.

BACKGROUND OF THE INVENTION

This invention relates generally to electrostatographic reproduction machines, and more particularly to a machine including a belt position changing mechanism for reducing sheet edge wear defects from a contact belt fusing apparatus therein.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roller or to a latent image on the photoconductive member. The toner attracted to a donor roller is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rollers with the toner image contacting the heated fuser roller to thereby effect heating of the toner images within the nip. In a Nip Forming Fuser Roller (NFFR), the heated fuser roller is provided with a layer or layers that are deformable by a harder pressure roller when the two rollers are pressure engaged. The length of the nip determines the dwell time or time that the toner particles remain in contact with the surface of the heated roll.

The heated fuser roller is usually the roller that contacts the toner images on a substrate such as plain paper. In any event, the roller contacting the toner images is usually provided with an adhesive (low surface energy) material for preventing toner offset to the fuser member. Three materials which are commonly used for such purposes are PFA, Viton™ and silicone rubber.

Roller fusers work very well for fusing color images at low speeds since the required process conditions such as temperature, pressure and dwell can easily be achieved. When process speeds approach 100 pages per minute (ppm) roller fusing performance starts to falter. At such higher speeds, dwell must remain constant which necessitates an increase in nip width. Increasing nip width can be accomplished most readily by either increasing the fuser roller (FR) rubber thickness and/or the outside diameter of the roll. Each of these solutions reach their limit at about 100 ppm. Specifically, the rubber thickness is limited by the maximum temperature the rubber can withstand and the thermal gradient across the elastomer layer. The roller size becomes a critical issue for reasons of space, weight, cost, & stripping.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 5,250,998 granted to Ueda et al on Oct. 5, 1993 discloses a toner image fixing device wherein there is provided an endless belt looped up around a heating roller and a conveyance roller, a pressure roller for pressing a sheet having a toner image onto the heating roller with the endless belt intervening between the pressure roller and the heating roller. A sensor is disposed inside the loop of the belt so as to come in contact with the heating roller, for detecting the temperature of the heating roller. The fixing temperature for the toner image is controlled on the basis of the temperature of the heating roller detected by the sensor. A first nip region is formed on a pressing portion located between the heating roller and the fixing roller. A second nip region is formed between the belt and the fixing roller, continuing from the first nip region but without contacting the heating roller.

U.S. Pat. No. 5,465,146 granted to Hgashi et al on Nov. 7, 1995 relates to a fixing device to be used in electrophotographic apparatus for providing a clear fixed image with no offset with use of no oil or the least amount of oil, wherein an endless fixing belt provided with a metal body having a release thin film thereon is stretched between a fixing roller having a elastic surface and a heating roller, a pressing roller is arranged to press the surface of the elastic fixing roller upwardly from the lower side thereof through the fixing belt to form a nip portion between the fixing belt and the pressing roller, a guide plate for unfixed image carrying support member is provided underneath the fixing belt, between the heating roller and the nip portion, to form substantially a linear heating path between the guide plate and the fixing belt, and the metal body of the fixing belt has a heat capacity per $cm^2$ within the range of 0.001 to 0.02 cal/° C.

A problem encountered with heat and pressure fusers or fusing apparatus is fusing edge wear, or defects caused to the fusing surface by the edges of sheets being fused repeatedly along the same path through the fusing nip. Such paper or sheet edge wear of the fusing surface caused by such continuous paper or sheet edge contact in the exact same place ordinarily result in significant image defects when larger media is forced to travel over this worn edge. Such fusing surface edge wear is a significant problem for both roller and belt fusing apparatus. Although there may be disagreement as to the exact mechanical cause of edge wear, where it occurs, and its undesirable effects are easy to tell. It occurs on the fusing surface of a fusing belt or roller at the points of contact between the edges of the substrate being fused and the outer usually compliant surface layer of the fusing belt or roller. In most cases, fusing edge wear as such is seen and felt as a small groove around the roller or along the surface of the belt.

The amount of edge wear on any fusing surface ordinarily is directly related to the volume of a particular size substrate that is run using such surface. For example, when mostly 8.5"×11" (short edge feed) paper is run and fused through a machine at high volumes, it will cause two edge related wear marks, approximately 8.5" apart on the fusing surface. When 11"×17" paper is run and fused (short edge feed) through the machine, each of these two marks then shows up as a line defect on the 11"×17" fused image copy sheet, if the sheets are center registered. Edge registration of the sheets results only in one such line defect.

SUMMARY OF THE INVENTION

According to the present invention, there is provided an electrostatographic reproduction machine including a belt position changing mechanism for reducing sheet edge wear defects on image copies being produced therein. The electrostatographic reproduction machine includes a contact belt fusing apparatus having an endless fusing belt. The endless fusing belt has an external fusing surface defining a path of movement, and a plurality of support rollers for supporting and moving the endless fusing belt along the path of movement. The endless fusing belt as supported has a first fusing position aligned on the plurality of support rollers, and at least a second fusing position that is spaced axially from the first fusing position, and is aligned on the plurality of support rollers. The contact belt fusing apparatus also includes a heating member for heating the external fusing surface of the endless fusing belt, and a pressure roller forming a fusing nip with the external fusing surface of the endless fusing belt. The endless fusing belt is moved through the fusing nip along with toner image carrying sheets, the toner image carrying sheets having edges that induce wear on the external fusing surface of the endless fusing belt. Importantly, the electrostatographic reproduction machine includes a belt moving mechanism for controllably moving the endless fusing belt axially, relative to the plurality of rollers, from the first fusing position to the at least second fusing position, so as to reduce sheet edge wear on the external fusing surface of the endless fusing belt, and thus to reduce sheet edge wear defects on image copies being produced.

DESCRIPTION OF THE DRAWINGS

In the detailed description of the invention presented below, reference is made to the drawings, in which.

DETAILED DESCRIPTION OF THE INVENTION

Figure 1:
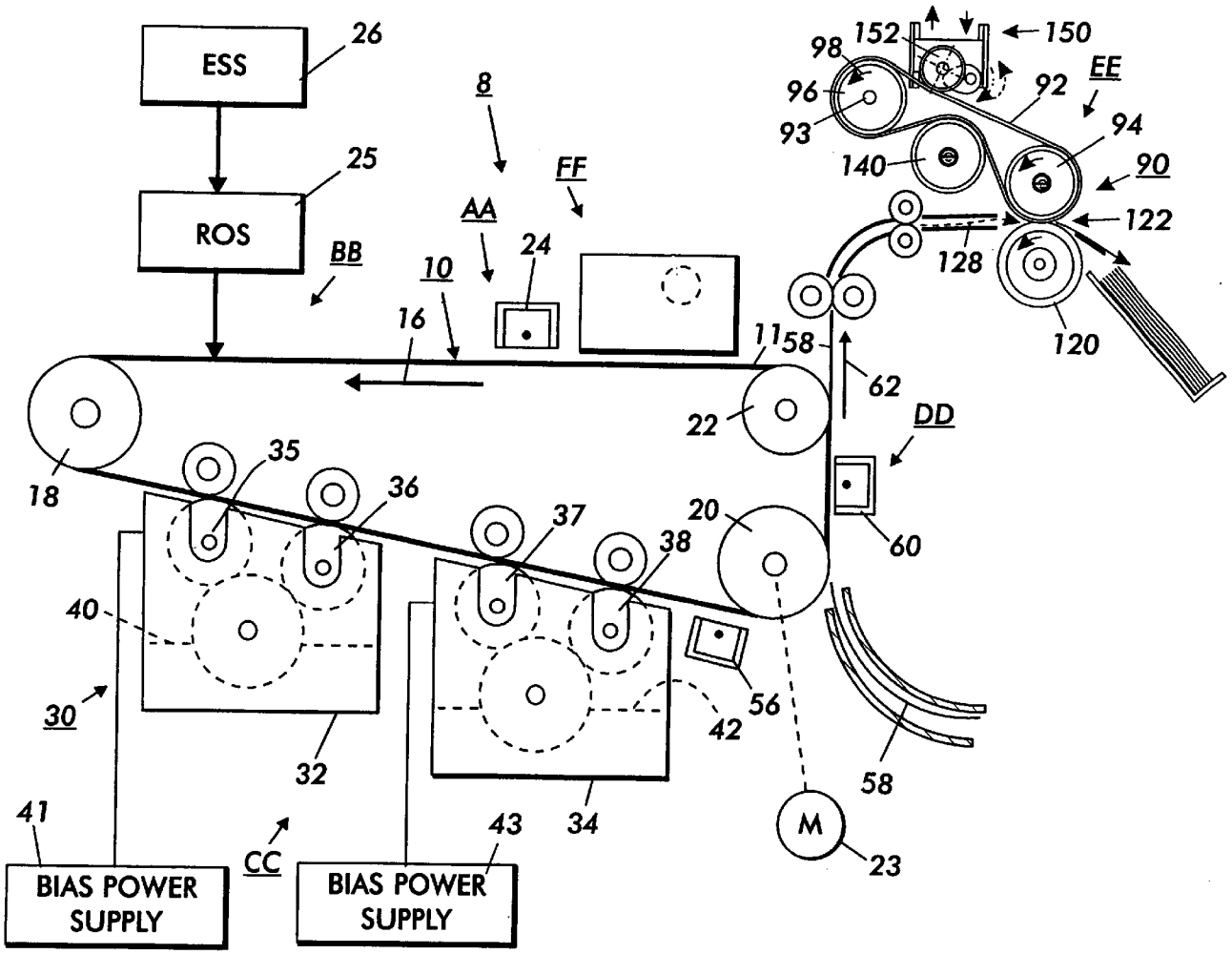
FIG. 1 is a schematic illustration of an electrostatographic reproduction machine incorporating the belt position changing mechanism of the present invention

While the present invention will be described in connection with a preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Referring now to the drawing (FIG. 1), where the showings are for the purpose of describing a preferred embodiment of the invention and not for limiting same, and where the various processing stations employed in an electrostatographic reproduction machine as illustrated in FIG. 1, will be described only briefly.

As illustrated, an electrostatographic reproduction machine 8, in which the present invention finds advantageous use, utilizes a charge retentive image bearing member in the form of a photoconductive belt 10 consisting of a photoconductive surface 11 and an electrically conductive, light transmissive substrate. The belt 10 is mounted for movement past a series of electrostatographic process stations including a charging station AA, an exposure station BB, developer stations CC, transfer station DD, fusing station EE and cleaning station FF. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Roller 20 is coupled to motor 23 by suitable means such as a belt drive. Motor 23 rotates roller 20 to advance belt 10 in the direction of arrow 16.

As can be seen by further reference to FIG. 1, initially successive portions of belt 10 pass through charging station AA. At charging station AA, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station BB. At exposure station BB, the uniformly charged photoreceptor or charge retentive surface 10 is exposed to a laser based input and/or output scanning device 25 which, as controlled by controller or ESS 26, causes the charge retentive surface to be discharged in accordance with the output from the scanning device. The ESS 26, for example, is the main multi-tasking processor for operating and controlling all of the other machine subsystems and printing operations, including aspects of the present invention. The scanning device is a three level laser Raster Output Scanner (ROS). The resulting photoreceptor contains both charged-area images and discharged-area images.

At development station CC, a development system, indicated generally by the reference numeral 30 advances developer materials into contact with the electrostatic latent images, and develops the image. The development system 30, as shown, comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40, by way of example, contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pretransfer corona discharge member 56 is provided to condition the toner for effective transfer to a substrate using corona discharge of a desired polarity, either negative or positive.

Sheets of substrate or support material 58 are advanced to transfer station DD from a supply tray, not shown. Sheets are fed from the tray by a sheet feeder, also not shown, and advanced to transfer station DD through a corona charging device 60. After transfer, the sheet continues to move in the direction of arrow 62 towards fusing station EE.

As illustrated, fusing station EE includes a contact belt fusing apparatus 90. The fusing apparatus 90 includes an endless fusing belt 92 that is supported for movement in an endless path in the direction of the arrow 98 by a pair of rollers 94 and 96. The rollers 94 and 96 are a pair of pressure engageable belt support rollers of which the roller 94 can be a drive roller and the roller 96 is an idler roller cooperating with the roller 94 to support and move the belt 92 in and endless loop or path of movement in the direction of the arrow 98.

A second pressure roller 120 is mounted externally to the belt 92 for pressure engagement with the belt 92 against the roller 94 such that the belt 92 is sandwiched therebetween in order to form a fusing nip 122. Imaged substrates such as the sheet of plain paper 58 carrying toner images 126 move in the direction of the arrow 128 pass through the nip 122 with the toner images contacting an outer surface 130 of the belt 92. The fusing nip 122 comprises a single nip, in that, the section of belt contacted by the roller 94 is coextensive with the opposite side of the belt contacted by roller 120. In other words, neither of the rollers 94 and 120 contact a section of the belt not contacted by the other of these two rolls. A single nip insures a single nip velocity through the entire nip.

The belt 92 preferably comprises silicone rubber of the type conventionally utilized in roller fusers. The thickness of the belt 92 is in the order of 0.006 to 0.925 inch. The deformable belt 92 provides the same function as the deformable layer of a Nip Forming Fuser Roller (NFFR), that is, it is self stripping. Also, smaller nip pressure rollers can be used in this belt fuser since the deformable belt, not the roller diameter, is the major contributor for generating the nip required for higher speed fixing of toner images. Smaller roller diameters also equate to more reliable stripping.

Fusing surface 130 of the belt 92 is elevated to fusing temperature by means of an internally heated roller 140 having a conventional quartz heater 142 disposed internally thereof. The roller 140 comprises a relatively thin (0.022 to 0.2 inch) walled metal structure chosen for its good heat conducting properties. To this end the roller 140 may be fabricated from aluminum or steel.

A motor (not shown) operatively connected to the roller 94 through a conventional drive mechanism (not shown) provides for rotation of the roller 94. The frictional interface between the belt 92 and the roller 94 and between the belt 92 and the rollers 96 and 140 causes those rollers to be driven by the belt. Separate drive mechanisms (not shown) may be provided where necessary for imparting motion to the rollers 96, 120 and 140.

Figure 2:
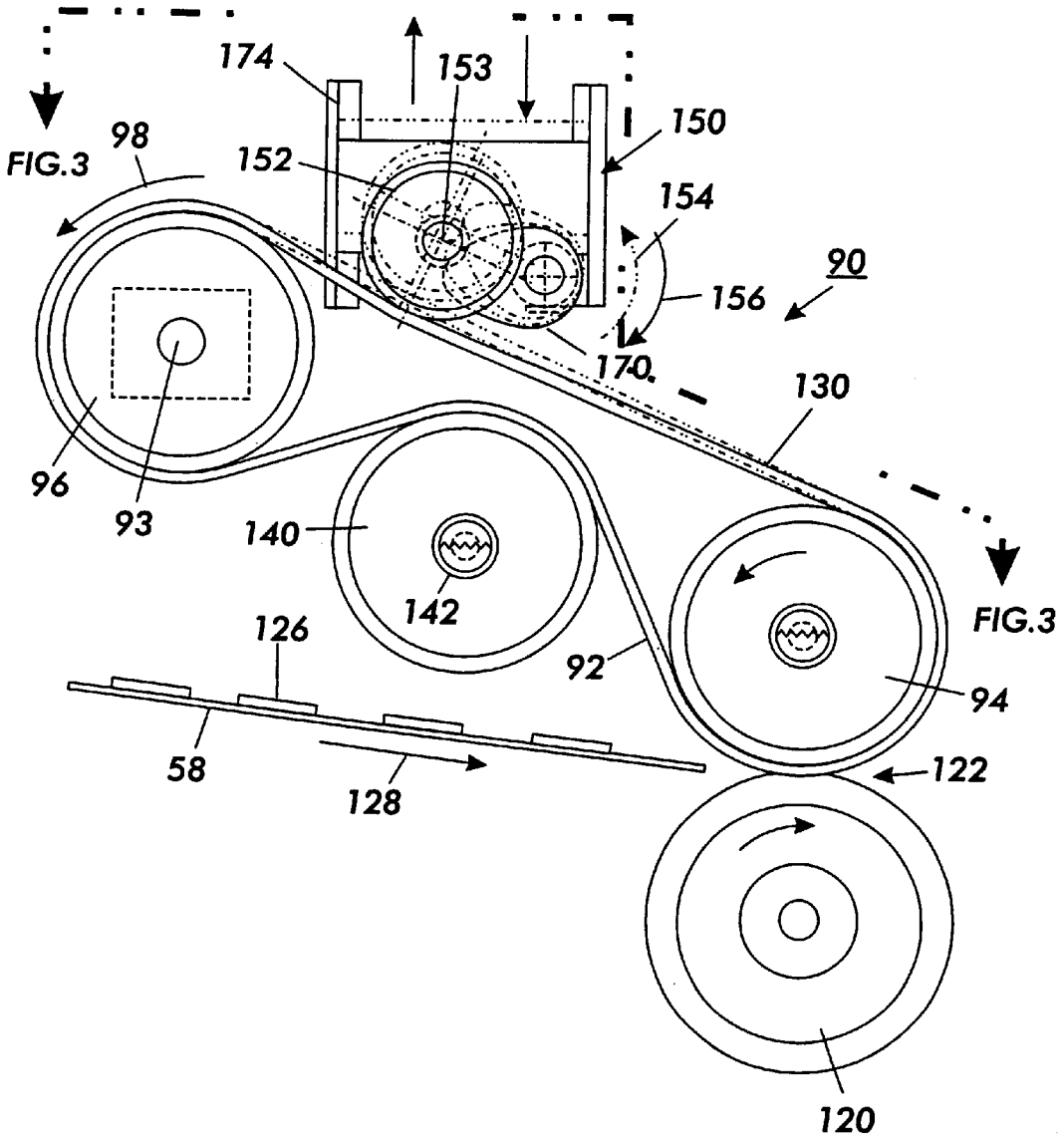
FIG. 2 is an end view schematic representation of a heat and pressure contact beft fusing apparatus of the machine of FIG. 1, showing the belt position changing mechanism in detail.
Figure 3:
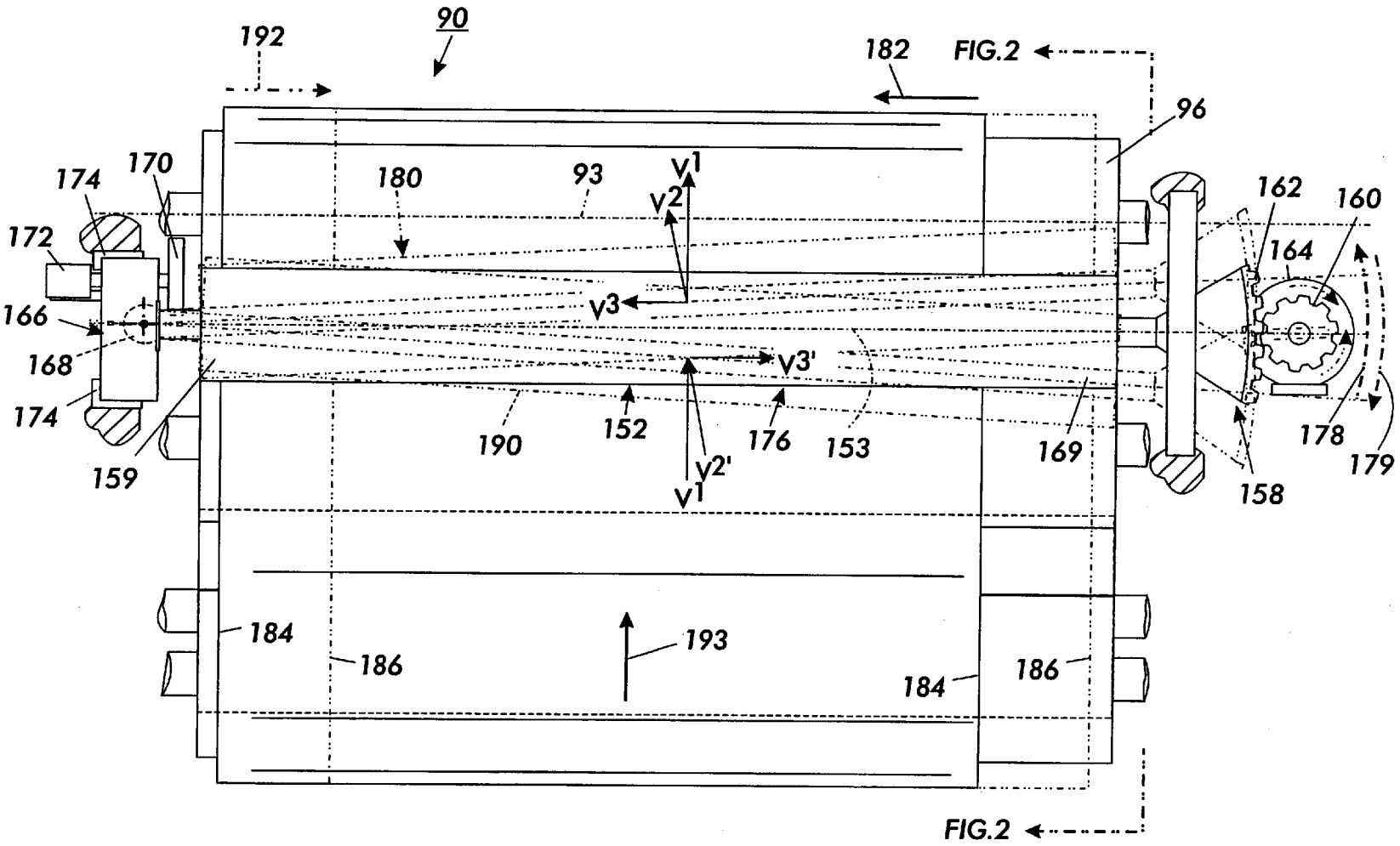
FIGS. 3 top view schematic representations of the invention illustrated in FIGS. 1 and 2, and showing belt moving velocities under skew, and a number of different axial positions of the belt relative to the rollers in accordance with the present invention.

Referring now to FIGS. 1–3, and as discussed above, the fusing apparatus 90 includes the endless fusing belt 92 having an external fusing surface 130 defining a path of movement. The fusing apparatus 90 also includes the plurality of support rollers 94, 96, 120 and 140 for supporting and moving the endless fusing belt 92 along the path of movement. As illustrated in FIG. 3, the endless fusing belt 92 as supported has a desired first fusing position 184 that is aligned on the plurality of support rollers, and at least a desired second fusing position 186 also aligned on the plurality of support rollers but spaced axially from the first position 184. The fusing apparatus also includes a pressure roller 120 forming a fusing nip 122 with the external fusing surface 130 of the endless fusing belt, for contacting and moving toner image carrying sheets 58 therethrough. Ordinarily, the edges of the toner image carrying sheets will induce undesirable wear on the external fusing surface 130 of the endless fusing belt, resulting in line defects on some fused copies.

Therefore, in accordance with the present invention, the electrostatographic reproduction machine 8 importantly includes a belt moving or position changing mechanism of the present invention, shown generally as 150, for moving the belt 92 and controllably changing its position axially relative to the plurality of rollers, 94, 96, 120 and 140. The belt moving mechanism 150 as such is suitable for controllably moving the endless fusing belt 92 axially, (relative to the plurality of rollers, 94, 96, 120 and 140), from the first fusing position 184 to the at least second fusing position 186, so as to reduce sheet edge wear in the same spot on the external fusing surface 130 of the endless fusing belt.

As illustrated, the belt moving assembly 150 includes a skewable roller 152 that has an axis 153, and is rotatable, and that is controllably movable up and down as shown (FIGS. 1 and 2) into and out of driven engagement with the belt 92. The belt moving assembly 150 also includes means such as a segmented mating gear assembly 158 at a first end 159 of the roller 152 for skewing the roller 152 as shown by the arrows 154, 156, relative to a line that is parallel to an axis, e.g. 93 of one (96) of the plurality of rollers supporting the belt 92. The mating gear assembly 158 for example includes a first gear 160 and a second gear 162 reversibly driven for example by a stepper motor 164. For precise and calculated skewing of the roller 152, the stepper motor 164 is coupled to the programmed controller such as the electronic control subsystem (ESS) 26 of a machine in which the fusing apparatus 90 is operating.

The moving assembly 150 further includes a pivot assembly 166 including a ball and socket joint 168, at a second and opposite end 169 of the roller 152, for enabling and allowing side to side skewing of the roller 152. A cam member 170 driven by a motor 172 is provided for lifting and lowering the roller 152 and its associated elements, up and down into frictional contact, relative to and with the fusing surface 130 of the belt 92. A pair of track slides 174 may be provided for guiding the roller 152 and its associated elements during movement by the cam member 170.

Referring in particular to FIG. 3, the roller 152 has a home position 176 with its axis 153 parallel to the longitudinal axis, e.g. 93, of any of the plurality of rollers 94, 96, 120 and 140. As shown, the roller 152 can then be skewed by moving its first end 159 in a first direction 178 or in a second direction 179, away from the home position 176. The roller 152 can be skewed as such into a first position 180, for moving the belt 92 in the direction of the arrow 182 from the belt's desired first fusing position 184, towards the belts at least desired second fusing position 186. The roller 152 can equally be skewed as such into a second position 190, for moving the belt 92 in the direction of the arrow 192 from the belt's at least desired second fusing position 186, towards the belts desired first fusing position 184.

An exaggerated difference is shown between the first position 184 and the at least second position 186 of the belt 92, only for illustrative purposes. In practice, a difference between adjacent such positions can be made as small as is practical given the control abilities of the stepper motor 164 and the mating gear assembly 158. As a result, instead of merely having a first and an at least second such positions, the belt 92 can have a multitude of such positions relative to the plurality of supporting rollers 94, 96,120 and 140.

By skewing the skewable roller 152 appropriately, frictional contact between it and belt 92 will cause it to rotate with relative velocities V1, V2, V2' and V3, V3' as shown (FIG. 4). As shown, V1 is parallel to the process direction, and because of the angle or skew of the roller 152, the roller 152 not only has a velocity V2, V2' that is normal to its axis 153, it also has a third velocity V3, V3' that is normal or perpendicular to the process direction 193. Such frictional rotation of the roller 152 induces surface tangent forces along the directions of velocities V1, V2, V2', and V3, V3', of which the tangential force along the velocity V3, V3' of the roller (normal to the process direction 93) acts to forcibly move the belt in the direction of the arrows 182, or 192 with velocities V3, or V3' respectively, depending on the direction of skew of the skewable roller 152. Thus as shown in FIG. 4, the skewable roller 152 can be skewed in a first direction 178 (so that its axis is located shown as 153') for moving the belt 92 in the direction of arrow 182 with velocity V3. The belt 92 can thus be moved in the direction of the arrow 182 from one desired fusing position to another, over many such desired fusing positions. The roller 152 can also be skewed in a second and opposite direction 179 (so that its axis is located shown as 153) for moving the belt 92 in the opposite direction of arrow 192 with velocity V3'. The belt 92 can thus also be moved in the direction of the arrow 192 from one desired fusing position to another, over many such desired fusing positions. Sensing and control of the positioning of the belt 92 at the many desired fusing positions can be accomplished by any conventional means such as proximity or other sensors connected to the controller 26.

On the high speed belt fusing fixture, it has been observed that slight misalignments of the rollers cause the belt to mistrack. This invention takes advantage of this tracking tendency by controlling the alignment of the rollers. The wander or changing of the position of the belt 92 from one to the others of such a multitude of positions would continually and advantageously vary the location of contact that each substrate or sheet 58 makes with the belt, and consequently spread the wear on the surface 130 out over a greater area. The wander or changing of the position of the belt 92 from one to the others can of course be completely random, or it can be predetermined and preprogrammed. Accordingly, the induced change in belt position can be strategically calculated and implemented through software and active tracking, or it can be part of a random passive type system. Suitable adjustments preferably should be made to the sheet or substrate input path, and the rate of change between belt positions should be in order to minimize or reduce the risks of wrinkling or damaging the substrate and/or image thereon.

Ordinarily, the belt moving assembly 150 is lifted and spaced from the surface 130 until needed to move or change a position of the belt. When needed as such, the rate or degree of change is calculated and translated into a required skew for the roller 152, as well as into a required time of contact between the roller 152 and belt 92. The roller 152 is then brought into skewed contact with the belt 92, for such required time so as to move the belt from one position thereof to another. Once the required move is over, the roller 152 is again lifted and spaced from the belt 92 until needed again.

As can be seen, there has been provided a contact belt fusing apparatus is provided for reducing sheet edge wear defects in fused copies. The fusing apparatus includes an endless fusing belt having an external fusing surface defining a path of movement and a plurality of support rollers for supporting and moving the endless fusing belt along the path of movement. The endless fusing belt as supported has a first fusing position aligned on the plurality of support rollers at a first location, and at least a second fusing position aligned on the plurality of support rollers at a second location that is spaced axially from the first location thereon. The fusing apparatus also includes heating member for heating the external fusing surface of the endless fusing belt, and a pressure roller forming a fusing nip with the external fusing surface of the endless fusing belt for contacting and moving toner image carrying sheets therethrough, the toner image carrying sheets having edges that induce wear on the external fusing surface of the endless fusing belt. Importantly, the fusing apparatus includes a belt moving mechanism for controllably moving the endless fusing belt axially, relative to the plurality of rollers, from the first fusing position to the at least second fusing position, so as to reduce sheet edge wear on the external fusing surface of the endless fusing belt.

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

What is claimed is:

1. A contact belt fusing apparatus for reducing sheet edge wear defects, the fusing apparatus comprising:

(a) an endless fusing belt having an external surface defining a path of movement;

(b) a plurality of support rollers for supporting and moving said endless fusing belt along said path of movement, said endless fusing belt as supported having a first fusing position centered axially on said plurality of support rollers at a first location, and at least a second fusing position centered axially on said plurality of support rollers at a second location spaced axially from said first location thereon;

(c) heating means for heating said external surface of said endless fusing belt;

(d) a pressure roller forming a fusing nip with said external surface of said endless fusing belt for contacting and moving therethrough toner image carrying sheets having edges inducing wear on said external surface of said endless fusing belt; and (e) belt position changing means for controllably moving said endless fusing belt axially relative to said plurality of support rollers from said first fusing position to said at least second fusing position so as to reduce sheet edge wear on said external surface of said endless fusing belt, said belt position changing means comprising a rotatable and skewable roller that is movable into and out of driven engagement with said endless fusing belt.

2. The fusing apparatus of claim 1, wherein rollers comprising said plurality of support rollers have parallel axes.

3. The fusing apparatus of claim 1, wherein rollers comprising said plurality of support rollers are mounted into contact with an inner surface of said endless fusing belt.

4. The fusing apparatus of claim 1, wherein said endless fusing belt as supported has a multitude of fusing positions variably aligned axially on said plurality of support rollers.

5. The fusing apparatus of claim 1, wherein said heating means comprises a heated roller in contact with said external surface of said endless fusing belt.

6. The fusing apparatus of claim 1, wherein said belt position changing means further includes a gear assembly at a first end of said skewable roller for moving said skewable roller from side to side relative to a line parallel to an axis of one of said plurality of support rollers.

7. The fusing apparatus of claim 6, wherein said belt position changing means further includes a pivot assembly at a second and opposite end of said skewable roller for enabling side to side movement of said skewable roller.

8. An electrostatographic reproduction machine for producing copy sheets without belt skew defects, comprising:

(a) means including a movable image bearing member, for forming and transferring a toner image onto a substrate; and (b) a fusing apparatus for reducing belt skew defects on fused copies, the fusing apparatus including:

(i) an endless fusing belt having an external surface defining a path of movement;

(ii) a plurality of support rollers for supporting and moving said endless fusing belt along said path of movement, said endless fusing belt as supported having a first fusing position centered axially on said plurality of support rollers at a first location, and at least a second fusing position centered axially on said plurality of support rollers at a second location spaced axially from said first location thereon;

(iii) heating means for heating said external surface of said endless fusing belt;

(iv) a pressure roller forming a fusing nip with said external surface of said endless fusing belt for contacting and moving therethrough toner image carrying sheets having edges inducing wear on said external surface of said endless fusing belt; and (v) belt position changing means for controllably moving said endless fusing belt axially relative to said plurality of support rollers from said first fusing position to said at least second fusing position so as to reduce sheet edge wear on said external surface of said endless fusing belt, said belt position changing means comprising a rotatable and skewable roller that is movable into and out of driven engagement with said endless fusing belt.

* * * * *